United States Patent [19]

Wong et al.

[11] Patent Number: 4,812,788

[45] Date of Patent: Mar. 14, 1989

[54] WAVEGUIDE MATRIX INCLUDING IN-PLANE CROSSOVER

[75] Inventors: Mon N. Wong, Torrance; Robert J. Patin, Hawthorne; Theodore S. Fishkin, Lawndale; Donald C. D. Chang, Thousand Oaks, all of Calif.

[73] Assignee: Hughes Aircraft Company, Los Angeles, Calif.

[21] Appl. No.: 115,952

[22] Filed: Nov. 2, 1987

[51] Int. Cl.[4] ..... H01P 5/18

[52] U.S. Cl. ..... 333/113; 333/117

[58] Field of Search ..... 333/109, 113, 114, 117

[56] References Cited

U.S. PATENT DOCUMENTS

| | | | |
|---|---|---|---|
| 2,574,790 | 11/1951 | King, Jr. | 333/109 X |
| 2,876,421 | 3/1959 | Riblet | 333/113 |
| 3,183,457 | 5/1965 | Carter et al. | 333/113 |
| 3,295,134 | 12/1966 | Lowe | 333/101 X |
| 3,614,672 | 6/1969 | Newbould | 333/113 |
| 3,727,152 | 6/1971 | Bodonyi | 333/135 |
| 4,556,855 | 12/1985 | Chiang et al. | 333/113 |
| 4,679,011 | 7/1987 | Praba et al. | 333/113 X |
| 4,686,493 | 8/1987 | Chang et al. | 333/113 |
| 4,691,177 | 9/1987 | Wong et al. | 333/113 |

*Primary Examiner*—Eugene R. Laroche

*Assistant Examiner*—Benny Lee

*Attorney, Agent, or Firm*—Steven M. Mitchell; Mark J. Meltzer; A. W. Karambelas

[57] ABSTRACT

An assembly of waveguides and coupling apertures located within walls separating the waveguides is formed within a planar configuration. The coupling apertures are arranged either singly or in pairs, with one coupling aperture behind the other coupling aperture, to provide for a division of power between waveguides and to provide for a crossing over of power from one waveguide to another waveguide. The waveguide assembly is reciprocal in operation so that the single coupling apertures may be employed for a distribution as well as for a combination of electromagnetic waves. Phase shifters may also be included to provide a desired phase relationship among waves outputted by various ones of the waveguides. The waveguides, the walls separating the waveguides, the coupling apertures and the phase shifters may all be fabricated in a parallel array within a common metallic plate by automated milling machines for facile, accurate, and reproducible manufacture of the wavguide assembly. The waveguide assembly including the matrix of passages for electromagnetic waves is readily structured to serve as a Butler matrix.

10 Claims, 4 Drawing Sheets

FIG. 5
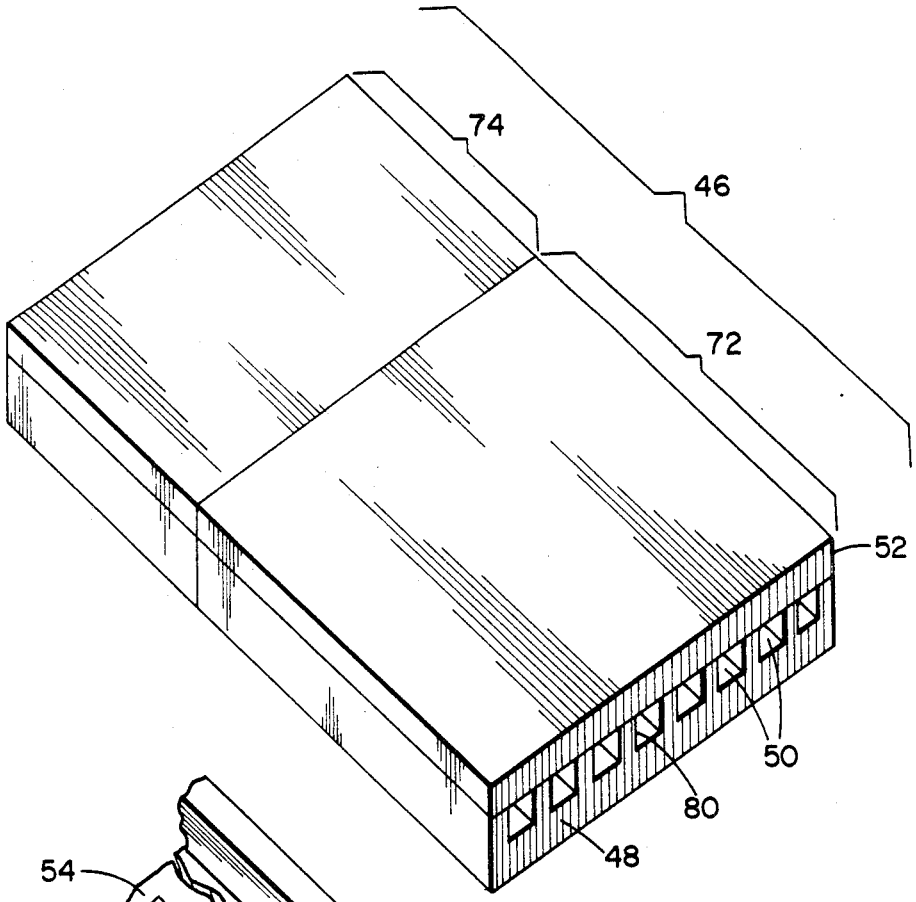
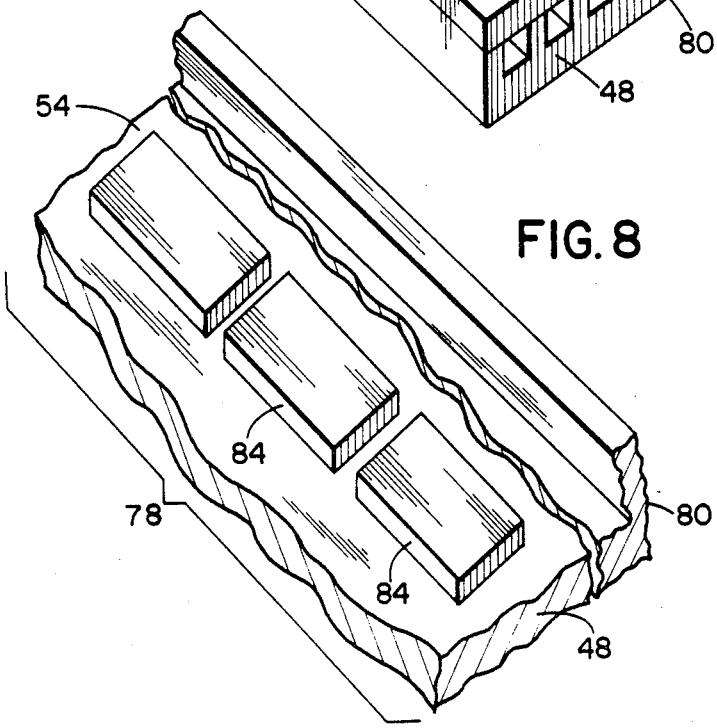
FIG. 8

ILLUSTRATION OF RF FLOW OF INPUT ※1

WAVEGUIDE MATRIX INCLUDING IN-PLANE CROSSOVER

This invention was made with government support under contract No. F04701-85-C-0067 awarded by the Air Force. The government has certain rights in this invention.

BACKGROUND OF THE INVENTION

This invention relates to a waveguide matrix, particularly a Butler matrix for the distribution of electromagnetic energy from one of a plurality of input ports among a plurality of output ports and, more particularly, to a waveguide construction wherein paired coupling devices in divider walls which separate adjacent waveguides provide for an in-plane crossing of power from one waveguide to another waveguide.

In the processing of electromagnetic signals, it is frequently advantageous to distribute and combine algebraically signals propagating in a set of waveguides. A common example of such combination is found in the feeding of antenna elements in an array antenna in which each element is fed microwave energy via a waveguide. As is well known, the contributions of electromagnetic energy applied to each of the antenna elements radiate as waves, and combine to form a beam upon suitable phasing of the waves radiated by the respective elements. The difference in phase among waves of the various elements, sometimes referred to as a phase taper or phase slope, can be selected to adjust a direction of radiation of the beam from the antenna.

One form of microwave distribution system for distributing the electromagnetic energy among the antenna elements is composed of a set of waveguides interconnected to form a matrix of paths for the conduction of electromagnetic energy, the composite waveguide structure being known as a Butler matrix. The Butler matrix is well known and may be used for coupling, by way of example, a set of four input ports to a set of four output ports, a set of eight input ports to a set of eight output ports, or other number of ports such as sixteen input ports to sixteen output ports. Assuming by way of further example that the output ports are connected to an array antenna and the input ports are connected via a selector switch to a transmitter, energization of any one of the input ports with electromagnetic power provides for a uniform distribution of the electromagnetic power among the full set of output ports to provide for a radiated beam from the antenna. The direction of the beam relative to the array of antenna elements differs with each selected one of the input ports. Thereby, by operation of the selector switch, a beam may be generated in any desired one of a set of of possible directions. The Butler matrix is reciprocal in operation so that a receiving beam of radiation can be outputted at any one of the input ports for coupling by the selector switch to a receiver.

A Butler matrix is composed of numerous 3 dB (decibels) couplers interconnecting waveguides whereby power in one waveguide can be distributed equally between the waveguide and a second waveguide. A 90 degree phase shift is introduced at the coupler between waves carrying each half of the power. Therefore, various phase relationships exist among waves travelling in the various waveguides. In order to provide for a desired phase taper at the output ports for forming a beam on transmission, and in order to sum together the contributions from various antenna elements during reception of an incoming electromagnetic wave, additional phase shifters are connected into the waveguides. A further aspect in the construction of a Butler matrix is the presence of numerous crossovers in which one waveguide is provided with twists and turns to cross over another waveguide, thereby to allow interconnection and coupling of signals between various combinations of the waveguides.

A problem arises in the construction of a Butler matrix, or other matrix of waveguides employed for the algebraic combination of electromagnetic waves, in that the manufacture of waveguides with twists and turns to effect a crossover is difficult. Furthermore, in the case of a matrix interconnecting many input ports with many output ports, there are crossings of waveguides above other crossed over waveguides resulting in a microwave structure of highly irregular shape and excessively large size which is difficult to incorporate into a microwave system.

SUMMARY OF THE INVENTION

The foregoing problem is overcome and other advantages are provided by a waveguide matrix having an in-plane construction in accordance with the invention. The matrix is constructed by placing the waveguides in a side-by-side array sharing a common top wall and a common bottom wall with divider walls connecting between the top wall and the bottom wall to define the individual waveguides. The divider walls serve as sidewalls for the various waveguides.

In accordance with the invention, coupling structures, preferably in the form of apertures, are disposed within the divider walls. It has been found that two 3 dB couplers, each of which introduces the above noted 90 degree phase shift, can be arranged serially along a divider wall to provide for a division and recombination of the power of an electromagnetic wave such that an electromagnetic wave propagating along one waveguide passes through the pair of coupling apertures into the adjacent waveguide to be reformed as an electromagnetic wave identical to the original electromagnetic wave. Thereby, there has been a crossing over of an electromagnetic wave from one waveguide to the adjacent waveguide. It is noted, in particular, that this crossing over of the electromagnetic wave has been accomplished in a common plane of the two waveguides, and without the introduction of any twisting and turning of waveguides as has been required heretofore to effect a crossing over of a wave from the position of one waveguide to the position of another waveguide.

The resulting waveguide structure has a much simpler form than has been possible heretofore because all of the waveguides and the waveguide components, such as couplers, filters, and crossovers, lie within a common plane. Such structure is readily incorporated into a microwave system and allows for a compact emplacement of components of the system. A further advantage is obtained from the in-plane configuration because all of the waveguides can be milled out of a single metal plate. This allows the waveguide assembly to be made by numerically controlled milling machines, and also allows for many waveguide matrices to be constructed readily with identical electrical characteristics. In a preferred embodiment of the invention, the coupling apertures in the divider walls are rectangular and extend from top to bottom; accordingly, the apertures can be fabricated by milling out portions of the divider walls. Phase shifters which are usually formed as low ridges, or abutments, along the broad walls of the waveguides can readily be formed in the milling operation. The waveguide assembly is completed by placing a cover plate on top of the milled-out base plate containing the cut out waveguide channel. Connection to the ends of the waveguides at the front and back ends of the assembly can be made by waveguide, or by coax-to-waveguide transitions which complete the input and the output ports of the waveguide assembly. If desired, mounting flanges can be constructed at the end walls of the waveguide assembly to facilitate interconnection of the waveguide assembly to other microwave components.

BRIEF DESCRIPTION OF THE DRAWING

The foregoing aspects and other features of the invention are explained in te following description, taken in connection with the accompanying drawing wherein:

FIG. 5 is a stylized isometric view of an in-plane waveguide assembly incorporating the invention;

FIG. 8 is a fragmentary view of a waveguide of the assembly of FIGS. 5 and 6 disclosing a segmented ridge structure of a phase shifter.

DETAILED DESCRIPTION

Figure 1:
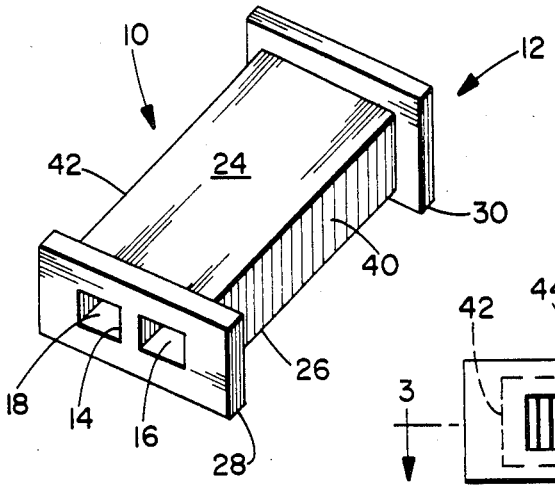
FIG. 1 is an isometric view of a waveguide crossover employed in construction of the waveguide matrix of the invention.

In the figures, the first four figures disclose the construction of a planar waveguide crossover suitable for use for the in-plane waveguide matrix of the invention, while FIGS. 5–8 show the construction of the waveguide matrix. The description of the construction of the invention will begin, therefore, with a description of a pair of waveguide couplers formed as a unitary crossover assembly suitable for use in the construction of waveguide circuitry and, in particular, in the construction of the waveguide matrix of the invention. The description of the crossover is then followed by a description of the construction of the waveguide matrix.

With reference to FIGS. 1–4, a waveguide crossover 10 is constructed in accordance with the invention and comprises a rectangular waveguide structure 12 having a central wall 14 extending lengthwise along a central axis of the structure 12. The central wall 14 divides the structure 12 into two rectangular waveguides 16 and 18 arranged side-by-side. Apertures 20 and 22 are provided in the central wall 14 for coupling electromagnetic energy between the waveguides 16 and 18 (see FIG. 3).

The structure 12 includes a top wall 24 and a bottom wall 26, the top wall 24 also serving as a top wall for each of the waveguides 16 and 18, and the bottom wall 26 also serving as a bottom wall for each of the waveguides 16 and 18. Thereby, each of the waveguides 16 and 18 are coplanar. Each of the apertures 20 and 22 extends from the top wall 24 to the bottom wall 26.

The length of each of the apertures 20 and 22 is one-half of the guide wavelength of electromagnetic radiation propagating through the crossover 10 so as to provide for directional coupling of radiant energy between the two waveguides 16 and 18, whereby energy flows in the same direction in both of the waveguides 16 and 18. Mounting flanges 28 and 30 are provided for mounting external waveguides 32, 34, 36, and 38, shown in phantom in FIG. 4, to the crossover 10. The mounting flanges 28 and 30 are not required in the construction of the waveguide matrix of the invention, and will be deleted in the construction of the waveguide matrix to be disclosed with reference to FIGS. 5–8.

Figure 2:
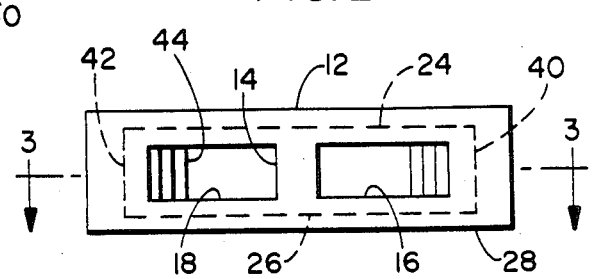
FIG. 2 is an end view of the crossover of FIG. 1, FIG. 2 showing two input ports of the crossover.

In the rectangular configuration of the waveguide 16 and 18, as shown in FIG. 2, the top and the bottom walls 24 and 26 serve as the broad walls of the waveguides 16 and 18, while the central wall 14 serves as a short sidewall of each of the waveguides 16 and 18. In the configuration shown, the coupling is done via the sidewall. It is to be understood, by way of alternative embodiments of the invention, that the configurations of the waveguides 16 and 18 might be altered such that the central wall 14 would be the long wall, in which case long-wall coupling would be employed. Sidewalls 40 and 42 of the structure 12 also serve as sidewalls of the waveguides 16 and 18, respectively.

The spacing between the two apertures 20 and 22 is at least approximately one-half of the guide wavelength to permit independent coupling operation by each of the apertures 20 and 22. The waveguide 16 has an input port and an output port, and the waveguide 18 has an input port and an output port for a total of four ports to the crossover 10. To facilitate discussion of the operation, the four ports are labeled port 1–4 in FIG. 3. Port 1 and port 2 are respectively input and output ports of the waveguide 16; port 3 and port 4 are respectively output and input ports of the waveguides 18. An input electromagnetic wave at the first port is indicated by a dashed line at G. The wave splits at the aperture 20 into two waves, designated E and F, with subsequent splittings of the wave occurring at the aperture 22 to result in four component waves labeled A, B, C, and D.

In operation, the input wave at G splits at the first aperture 20 into two waves E and F having equal power, which power is equal to one-half of the original power at G. The wave at E is shifted 90 degrees lagging relative to the wave at F. At the second aperture 22, the wave E splits into two components B and C having equal power, the power in the wave components B add C each being equal to one-quarter of the input power at G. Similarly, the wave at F is split by the second aperture 22 into two wave components A and D having equal power, the power in each of the waves A and D being equal to one-quarter of the power at G. The wave at C is shifted in phase by a lagging ninety degrees relative to the wave at B. Similarly, the wave at A is shifted in phase by a lagging 90 degrees relative to the wave at D. As a result of the phase shifting, the wave component at C has undergone two ninety-degree phase shifts for a total phase shift of 180 degrees. Therefore, the wave component C destructively interferes with the wave component D resulting in a cancellation of all power outputted at port 2. Therefore, none of the power of the wave at E is coupled through the second aperture 22; all of the power at E exits port 3. Similarly, none of the power at F exits port 2, all of the power being coupled via the second aperture 22 to exit port 3. Since the coupling of power via the first aperture 20 and via the second aperture 22 each introduce a lagging phase shift of 90 degrees, the contributions via both apertures are in phase at port 3, the two contributions each having a lagging phase shift of 90 degrees. Thus, the two contributions add cophasally to produce an output power at port 3 equal to the power inputted at port 1 neglecting the insertion phase of the device, the wave outputted at port 3 has a lagging phase of ninety degrees relative to the phase of the wave inputted at port 1.

To ensure a smooth flow of power through the coupling apertures 20 and 22, without the generation of undesirable reflections, impedance matching structures 44 are located on the sidewalls 40 and 42 opposite each of the apertures 20 and 22, there being a total of four of the matching structures 44. Each of the matching structures 44 comprises five steps, as viewed in FIG. 3, there being a top step in the middle with two steps on either side approaching the top step. Each of the steps has an extension of one-eighth of the guide wavelength, as measured along the central axis of the structure 12. Each of the steps is of equal height, as measured away from a sidewall 40 or 42, the total height of a structure 44 at the middle step being a distance of approximately one-quarter the spacing between the central wall 14 and a side wall 40 or 42. It is important that each of the apertures 20 and 22 be properly sized to provide for a coupling of one-half of the power in each case so as to insure the aforementioned cancellation of power transmitted within a waveguide resulting in the cross coupling of all of the inputted power.

Figure 4:
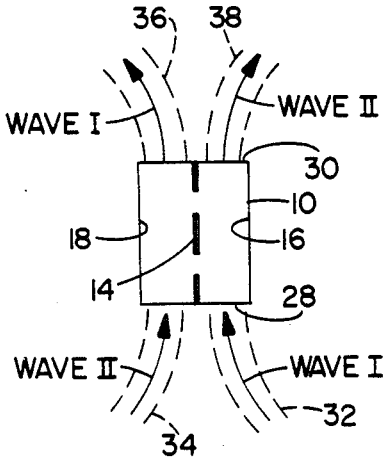
FIG. 4 is a diagrammatic view of the waveguide crossover showing two electromagnetic waves crossing over each other.

A similar diagram (not shown) can be presented for a wave inputted at port 4. Such wave will be outputted at port 2, with no power being outputted at port 3 by virtue of the foregoing explanation for waves propagating between ports 1 and 3. The propagation of a wave from port 4 to port 2 through the coupler 10 is independent of the propagation of a wave from port 1 to port 3 through the coupler 10. Therefore, as shown in FIG. 4, a first wave inputted via waveguide 32 and outputted at waveguide 36 crosses over a second wave inputted at waveguide 34 and outputted at waveguide 38. Such crossover occurs in a planar structure having no physical crossovers as a crossed-over waveguide. Rather, such crossover is accomplished by efficient use of space and weight of microwave components by two coplanar waveguides and two coupling apertures located in a common wall between the two coplanar waveguides. The operation of the coupler 10 is reciprocal such that, alternatively, the ports 2 and 3 may be employed as input ports and the two ports 1 and 4 may be employed as output ports so that, with reference to FIG. 4, waves traveling in the reverse directions to those indicated in FIG. 4 are also crossed over by the crossover 10.

Figure 6:
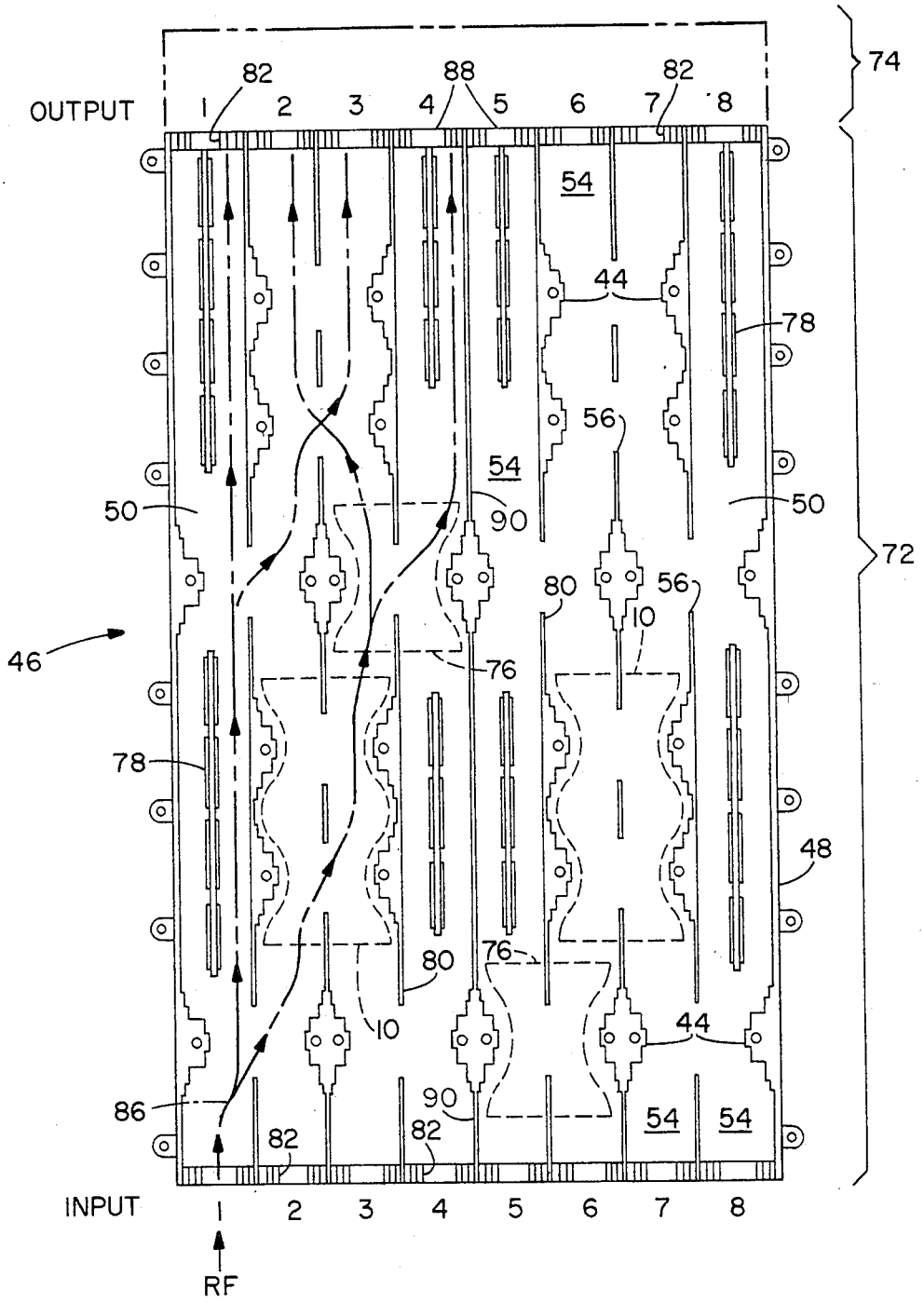
FIG. 6 shows a plan view of a base plate of a part of the assembly of FIG. 5, wherein there has been milled out the arrangement of waveguides, couplers, crossovers and phase shifters.
Figure 7:
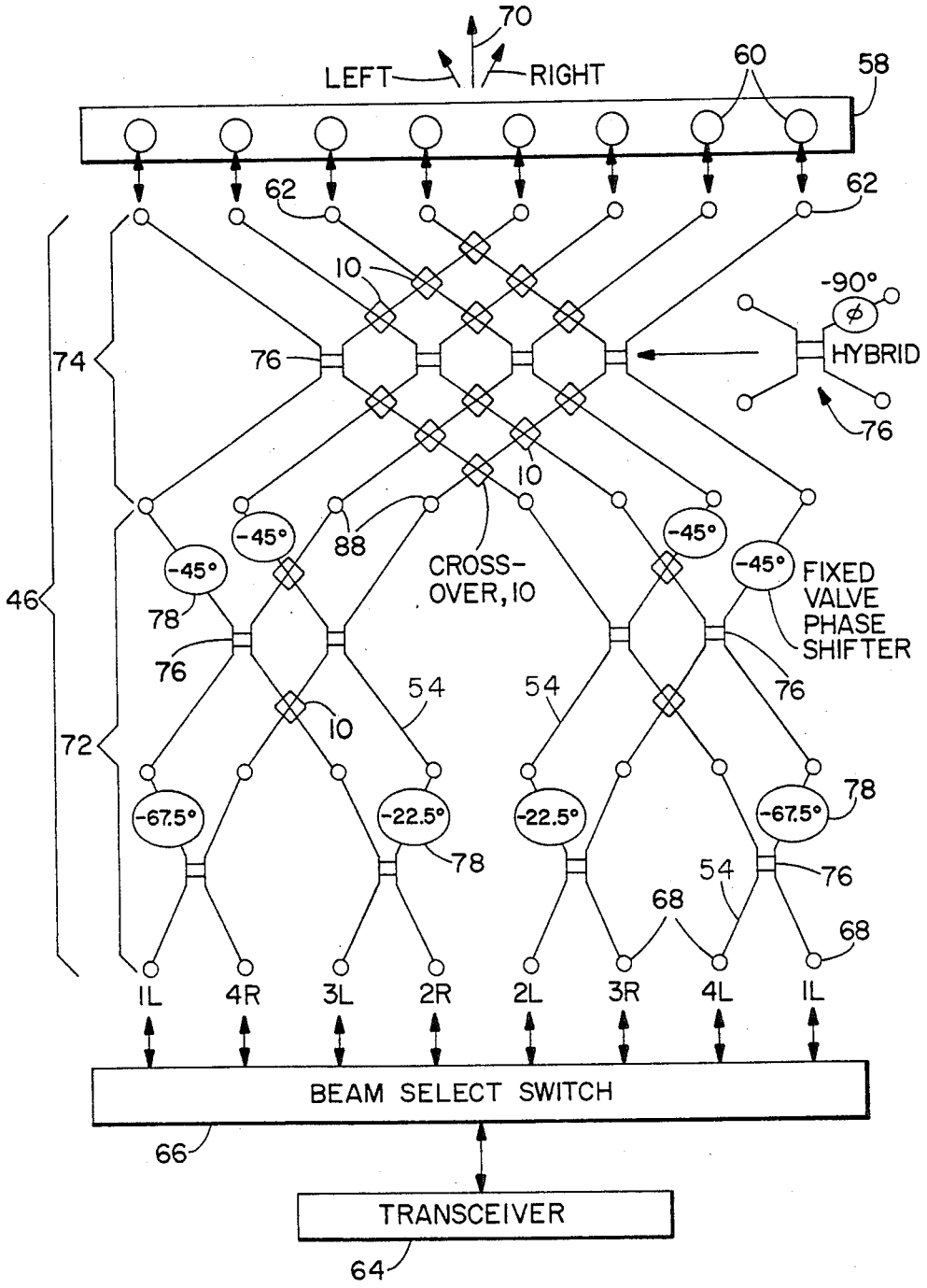
FIG. 7 shows diagrammatically the interconnections of all of the waveguides with all of the couplers, crossovers, and phase shifters in a complete Butler matrix employed, by way of example, with an array antenna of eight antenna elements, the physical construction of the matrix of conduction paths for electromagnetic power of FIG. 7 being in accordance with that shown in FIGS. 5 and 6.

With reference to FIGS. 5–8, there is shown a waveguide assembly 46 comprising a base plate 48 having channels 50 formed therein and being covered by a cover plate 52 to define a set of waveguides 54 coupled together by interconnecting passages 56 to form a matrix of conducting paths for propagation of electromagnetic power. The base plate 48 and the cover plate 52 are constructed of an electrically conductive material such as aluminum. While the general principles of construction of the waveguide assembly 46 are applicable to any form of in-plane matrix of waveguides or conducting paths, having various ratios of power coupled between waveguides and various phase and/or amplitude tapers, the invention will be described for a configuration of waveguide assembly operative in the manner of a Butler matrix and which is employed readily in situations requiring a Butler matrix. By way of example, FIG. 7 shows an antenna 58 having a linear array of antenna elements or radiators 60, such as horns, or dipoles, connected to a set of output ports 62 of the assembly 46. A transceiver 64 is connected by a beam selector switch 66 to a set of input ports 68 of the assembly 46. The number of input ports 68 is equal to the number of output ports 62, this number being eight in the exemplary construction set forth in the figures. By use of the waveguide assembly 46 and the selector switch 66, a beam of radiation can be generated at the antenna 58, which beam can be directed to the left or to the right of boresight 70 as indicated by a set of arrows in front of the antenna 58.

The waveguide assembly 46 may be manufactured from a single relatively large base plate 48 and cover plate 52 as shown in FIG. 5 or, alternatively, may be fabricated of two smaller assemblies 72 and 74 which are then butted together to form the complete assembly 46. Alternatively, if desired, the two sections 72 and 74 can be connected together by coaxial lines to allow emplacement of the two assemblies in different locations, or one on top of the other, as may be useful in the construction of a microwave system employing the invention. The division of the overall assembly 46 into the two smaller assemblies 72 and 74 is indicated also in FIG. 7 wherein the assembly 72 connects with the switch 66, and the assembly 74 connects with the antenna 58. In FIG. 6, the assembly 72 is shown in detail, while the outline of the assembly 74 is indicated in phantom.

To simplify the description, both of the assemblies 72 and 74 will be described with reference to the diagrammatic presentation of FIG. 7, while a description of the physical structure of various components of the complete assembly 46 will be presented with respect to only the smaller assembly 72, it being understood that the physical description applies also to the construction of the components of the smaller assembly 74. Both of the assemblies 72 and 74 comprise waveguides 54, crossovers 10, 3 dB hybrid couplers 76 (two of which are indicated in enlarged format in FIG. 7), while the assembly 72 includes also fixed phase shifters 78 providing differing values of phase shift as will be disclosed with reference to FIG. 7.

With reference to FIGS. 5–8, the assembly 72 is formed as a unitary structure by a milling procedure, described above, in which channels 50 and passages 56 are formed within the base plate 48. The channels 50 define an array of parallel waveguides 54 which are separated from each other by divider walls 80 extending from an input end of the assembly 72 at the switch 66 (FIG. 7) to an output end of the assembly 72 connecting with the assembly 74. The terms input and output are in reference to the transmission of a signal from the transceiver 64 to the antenna 58, it being understood that the waveguide assembly 46 operates reciprocally so that electromagnetic signals can flow equally well from the antenna 58 via the assembly 46 to the switch 66. Also shown in FIG. 6 are impedance matching structures which may be employed, if desired, for connecting both ends of the assembly 72 with waveguide-to-coaxial adapters for connection of coaxial cables to each of the waveguides 54. The divider walls 80 serve as side walls for each of the waveguides 54, the cross-sectional configuration of each of the waveguides being in the form of a two-by-one rectangular waveguide in which the height of the sidewalls is one-half the width of the broadwalls, the broadwalls being formed by the bottom of the base plate 48 and by the cover plate 52. In the preferred embodiment of the invention, the base plate 48, the cover plate 52 as well as the complete waveguide assembly 46 have a planar configuration. If desired, the planar configuration can be altered by constructing the assembly 46 on a slightly curved surface which would permit the emplacement of the assembly 46 within a curved wall of an airframe of an aircraft or satellite, it being understood that such curvature would be sufficiently gradual so as to allow propagation of electromagnetic waves through the waveguides 54 without significant reflection from such curvature.

Figure 3:
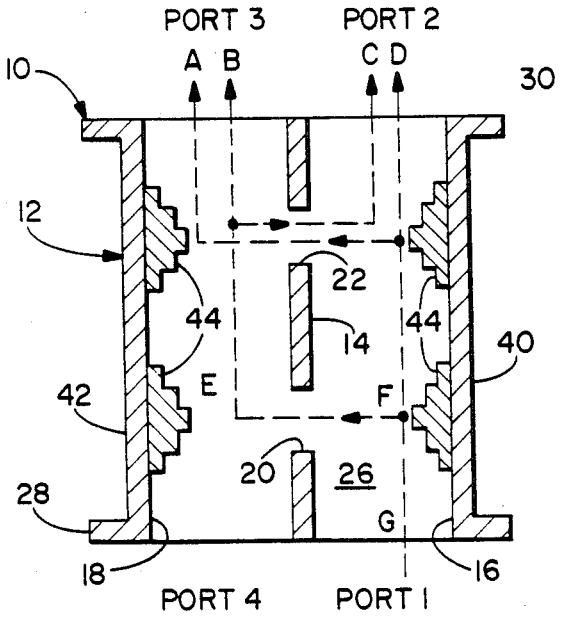
FIG. 3 is a sectional view taken along the line 3—3 in FIG. 2 showing a plan view of the interior of the crossover, the view including dashed lines showing propagation paths of radiant energy useful in explaining the operation of the crossover.

Upon comparing the structure of FIG. 3 with that of FIG. 6, it is noted that the passages 56 are formed within the divider walls 80 in the same fashion that the apertures 20 and 22 are formed within the central wall 14. In FIG. 3, the apertures 20 and 22 have the same rectangular configuration and are of the same size, this configuration and size being applied to the construction of the passages 56. Also, the impedance matching structures 44 facing the apertures 20 and 22 in FIG. 3 are also included in the structure of FIG. 6 wherein the impedance matching structures 44 are disposed on the divider walls 80 facing the passages 56. Thereby, the combination of a passage 56 with the matching structures 44 constitute a coupler 76. A pair of the couplers 76 arranged in tandem along a pair of adjacent ones of the waveguides 54 constitute the structure of the crossover 10 as was described in FIG. 3 Upon inspection of the assembly of FIG. 6, it is noted that each of the couplers 76 occurs as a single microwave structure when the function is to couple one-half of the power of an electromagnetic wave from one of the waveguides 54 to an adjacent waveguide 54. However, when two couplers 76 are arranged as a pair, one behind the other, then the two couplers 76 constitute a crossover 10. By way of example, phantom lines are employed in FIG. 6 to indicate selected ones of the couplers 76 and the crossovers 10, it being understood that other ones of the couplers 76 and the crossovers 10 can be identified by inspection of the assembly 72 of FIG. 6. While not shown in FIG. 6, it is to be understood that the same structural configurations of couplers 76 and crossovers 10 are found also in the assembly 74. The locations of all of the couplers 76 and all of the crossovers 10 are indicated diagrammatically in FIG. 7.

The phase shifters 78 of FIG. 7 are implemented in the structure of FIG. 6 by means of ridges 84 upstanding from the bottom wall of a waveguide at selective locations within the waveguides 54, the locations being designated by the diagram of FIG. 7. Corresponding ridges (not shown) may be formed in the top walls of the waveguides 54 by extension from the inner surface of the cover plate 52, if desired. Such ridges 84 are well known and introduce phase shift to electromagnetic signals propagating along the waveguides 54 by the introduction of capacitance between the top and bottom walls of a waveguide. The ridges 84 extend longitudinally along the center line of a broadwall of the waveguide and are segmented with termini of the segments being positioned at distances of one-quarter of the guide wavelength. Such segmentation tends to cancel any reflected waves which might otherwise be produced by impingement of electromagnetic wave upon the phase shifter 78. As is well known, the amount of capacitance introduced by each segment of a phase shifter 78 may be selected by adjustment of the width of a ridge 84, a widening of the ridge 84 increasing the capacitance, or by raising the height of a ridge 84, capacitance being increased by bringing the top surface of a ridge 84 closer to the opposite wall of the waveguide. A fragmentary view of a waveguide 54 with a set of segments of a ridge 84 forming a phase shifter 78 is disclosed in FIG. 8. The amount of capacitance and also the amount of phase shift can be selected, as is well known, by increasing the number of segments in the phase shifter 78. As may be seen by inspection of FIG. 6, the phase shifters 78 are constructed in different lengths to provide for fixed amounts of phase shift, the amounts of phase shift being indicated in FIG. 7.

The construction of FIG. 6 is to be employed for a Butler matrix. It is to be understood, however, that other matrices of conducting paths for electromagnetic waves can be constructed in a planar configuration in accordance with the invention. For example, while all of the couplers 76 of the assembly 46 are 3 dB couplers for coupling one-half of the power from one waveguide into an adjacent waveguide, the planar configuration of the assembly can also be employed with couplers which couple other fractions, such as one-quarter, or one-eighth of the power of one waveguide into an adjacent waveguide to be used in a signal processing operation other than that of forming a linear wavefront at an antenna. The principles of the invention are explained herein with reference to the Butler matrix, it being understood that these principles apply equally well to any other planar configuration of matrices of paths upon which electromagnetic waves propagate.

In order to demonstrate operation of the assembly 72 of FIG. 6, the waveguides 54 are numbered from 1 through 8 beginning on the left side of FIG. 6. A set of arrows 86, representing a flow of electromagnetic waves begins at the input port 68 at the first waveguide 54, and spread out among the first four waveguides 54 to exit from exit ports 88 (also shown in FIG. 7) of the assembly 72. Upon tracing the arrows 86, it is seen that power entering the first waveguide splits at the first coupler 76 to flow in equal quantities in the first two waveguides. The power in the second waveguide crosses over via a crossover 10 into the third waveguide. Thereupon, via two of the couplers 76, the power in the first waveguide is divided evenly between the first and the second waveguides, and the power in the third wavequide is divided evenly between the third and the fourth waveguide. Each of the first four waveguides now contains one-quarter of the power input at the first of the input ports 68. The waves propagating in the second and third waveguides then interchange positions via a crossover 10.

The same division of electromagnetic power can be observed by use of the diagram of FIG. 7 which presents the same couplers 76 and the same crossovers 10 as are shown in FIG. 6. The presentation in FIG. 7 continues beyond the exit ports 88 to show how the power in the first four waveguides is then coupled via additional ones of the crossovers 10 and additional ones of the couplers 76 to divide evenly among all eight of the output ports 62 of the waveguide assembly 46. It is readily verified by inspection, that a wave incident at any other one of the input ports 68 subdivides uniformly to exit at all of the output ports 62. In addition, the fixed phase shifts of the phase shifters 78 which introduce lagging phase shifts of 22.5 degrees, 45 degrees, and 67.5 degrees provide for a uniform phase taper or phase slope among the waves exiting from the output ports 62. These values of phase shift are in addition to the lagging phase shift of 90 degrees provided by each of the hybrid couplers 76.

By way of further description of the operation of the assembly 46, the input ports 68 have been further identified in FIG. 7 by the legends (1L, 4R) to (4L, 1R) identify specific ones of the eight beams to be generated by the antenna 58 in response to the application of an electromagnetic wave to any one of the various input ports 68. The numeral 1 indicates a beam which is directed close to boresight 70, while the numerals 2, 3 , and 4 represent larger angles of beam inclination relative to boresight 70. The letters L and R indicate that the beam is to the left or to the right of the boresight 70. In a preferred embodiment of the assembly 46, the waveguides 54 are of a standard size, size WR-62 for operating at a center of frequency of 17.5 GHz. The free-space wavelength is approximately 0.67 inch, the guide wavelength being greater. The height of the ridges 84 is 0.1 inch. The width of the ridges 84 is 0.05 inch. The indicated values of phase shift introduced by the phase shifter 78 produces a phase slope of 22.5 degrees between the exit ports 88 of the assembly 72 upon application of an electromagnetic wave to either of the input ports 68 designated 1L and 1R. Much larger values of phase slope are obtained by activation of other ones of the input ports 68. Test results for the assembly 72 show a voltage standing-wave-ratio of less than 1.25, a phase variation from the desired phase slope of less than 2.5 degrees, and an insertion loss of less than 0.2 dB. It should also be noted that, with respect to the foregoing values of phase slope, the values of phase shift attained for the exit ports 88 are symmetrical about a central wall 90 of the assembly 72 because of the symmetrical construction of the right and left halves of the assembly 72. Upon connection of the exit ports 88 via the assembly 74 to the output ports 62, there is provided one continuous phase taper across all eight of the output ports 62.

By virtue of the foregoing construction, the invention has provided a matrix of microwave passages for the distribution and combination of electromagnetic waves. The construction can be accomplished by automatic milling machinery to provide repeatably accurate assemblies of waveguides interconnected by coupling apertures. The construction provides for a crossing over of electromagnetic power from one waveguide to another within a common planar structure without the need for any passages for electromagnetic waves located outside of the planar configuration.

It is to be understood that the above described embodiment of the invention is illustrative only, and that modifications thereof may occur to those skilled in the art. Accordingly, this invention is not to be regarded as limited to the embodiment disclosed herein, but is to be limited only as defined by the appended claims.

What is claimed is:

1. A matrix of conductors of electromagnetic power between a first set of ports and a second set of ports comprising:

a top wall and a bottom wall, each of said walls extending in a longitudinal direction and in a transverse direction;

a set of divider walls extending from said top wall to said bottom wall, said divider walls extending in said longitudinal direction, individual ones of said divider walls being spaced apart from each other in said transverse direction to define a set of waveguides interconnecting said first set of ports with said second set of ports for coupling electromagnetic power therebetween, said divider walls serving as sidewalls of said waveguides, each of said waveguides connecting one port of said first set of ports with a corresponding port of said second set of ports;

a plurality of coupling means disposed at said sidewalls, each of said coupling means coupling a fraction of the power in one waveguide past a divider wall to an adjacent waveguide; and wherein said coupling means are arranged singly and in pairs along selected ones of said waveguides, a pair of said coupling means being two successive coupling means located at a single one of said sidewalls; and each of said pairs of said coupling means form a crossover for crossing the total electromagnetic power from one waveguide through a divider wall into an adjacent waveguide, a plurality of said crossovers and a plurality of said singly-arranged coupling means providing for a distribution of electromagnetic power form a port of said first set of ports among a plurality of ports of said second set of ports.

2. A matrix according to claim 1 wherein said top wall is planar.

3. A matrix according to claim 1 wherein said matrix has a planar form with all paths for conduction of electromagnetic energy via said crossovers lying within said planar form.

4. A matrix according to claim 1 wherein said fraction of power coupled by a coupling means is one-half of the power.

5. A matrix according to claim 4 wherein each of said coupling means introduces a 90 degree phase shift between waves carrying each half of the power.

6. A matrix according to claim 5 wherein said coupling means are distributed among said waveguides to provide for a Butler matrix.

7. A matrix according to claim 6 wherein each of said coupling means is formed as a rectangularly-shaped coupling aperture in a divider wall.

8. A matrix according to claim 7 further comprising impedance-matching protrusions disposed on sidewalls of said waveguides and extending inwardly towards coupling apertures to facilitate coupling of power through a coupling aperture.

9. A matrix according to claim 6 further comprising phase shifters formed as sections of said waveguides to provide a desired phase taper to electromagnetic waves outputted at said second set of ports.

10. A matrix according to claim 9 wherein each of said phase shifters comprises an elongated capacitive abutment disposed longitudinally along a wall of a waveguide.

* * * * *